US009436142B1

(12) United States Patent
Yamada

(10) Patent No.: US 9,436,142 B1
(45) Date of Patent: Sep. 6, 2016

(54) IMAGE FORMING APPARATUS, CONTROL METHOD FOR THE SAME, AND STORAGE MEDIUM STORING PROGRAM THEREIN

(71) Applicant: CANON KABUSHIKI KAISHA, Tokyo (JP)

(72) Inventor: Michihiko Yamada, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/013,104

(22) Filed: Feb. 2, 2016

(30) Foreign Application Priority Data

Feb. 20, 2015 (JP) ..... 2015-031929

(51) Int. Cl.
*G03G 15/20* (2006.01)

(52) U.S. Cl.
CPC ..... *G03G 15/2039* (2013.01)

(58) Field of Classification Search
USPC ..... 399/38, 42–44, 46, 67, 69
See application file for complete search history.

(56) References Cited

U.S. PATENT DOCUMENTS

| | | | | |
|---|---|---|---|---|
| 7,548,706 | B2 | 6/2009 | Yamamoto | |
| 7,769,311 | B2 * | 8/2010 | Tsubaki | G03G 15/2028 399/329 |
| 9,069,311 | B2 * | 6/2015 | Ohba | G03G 15/2039 |
| 9,207,603 | B2 * | 12/2015 | Murakami | G03G 15/2085 |
| 2008/0003005 | A1 | 1/2008 | Yamamoto | |

FOREIGN PATENT DOCUMENTS

JP 2008-15039 A 1/2008

* cited by examiner

*Primary Examiner* — Hoan Tran
(74) *Attorney, Agent, or Firm* — Fitzpatrick, Cella, Harper & Scinto

(57) ABSTRACT

An application amount of developer on a printing medium on which a page that is to be processed has been formed is obtained based on image data that includes a plurality of pages, and based on the image data, a coverage ratio of the developer on a printing medium on which a predetermined page has been formed is obtained. Then, setting temperatures of the heater that respectively correspond to the application amount and the coverage ratio are obtained, and the temperature of the heater is controlled based on the measured actual temperature of the heater and the obtained setting temperatures of the heater, thereby performing control to subject the printing medium on which the page that is to be processed has been formed to fixing.

11 Claims, 12 Drawing Sheets

IMAGE FORMING APPARATUS, CONTROL METHOD FOR THE SAME, AND STORAGE MEDIUM STORING PROGRAM THEREIN

BACKGROUND OF THE INVENTION

1. Field of the Invention

The present invention relates to an image forming apparatus, a control method for the same, and a storage medium for storing a program therein.

2. Description of the Related Art

Image forming apparatuses such as electrophotographic printers, copiers, facsimiles, and multifunction peripherals that serve as a combination thereof typically perform printing by forming a toner image on a printing medium based on image data, conveying the printing medium on which the toner image has been formed to a fixing device, and fixing the toner image.

The fixing device includes a heater for fusing toner, a fixing film for increasing the removability of the printing medium from the heater, and a pressure roller for pressing the printing medium against the fixing film while conveying the printing medium. The fixing device thus fuses the toner image on the printing medium and fixes the toner image to the printing medium within the fixing device by applying heat from the heater to the printing medium via the fixing film and applying pressure to the printing medium with the pressure roller while the printing medium is conveyed by the fixing film and the pressure roller.

Here, the temperature of the heater required for fusing and fixing toner varies depending on the thickness of the toner image on the printing medium. Therefore, Japanese Patent Laid-Open No. 2008-15039, for example, discloses technology by which the temperature of the heater of the fixing device is controlled to be as low as possible within a range in which a fixing failure does not occur at fusing and fixing of the toner image.

However, according to the above-described technology, the temperature of the heater is controlled by setting the same temperature for the entire printing medium, even when the toner image has a predetermined thickness only within a partial area of the printing medium. The following describes this situation with reference to FIGS. 1A to 1D.

FIG. 1A shows a situation in which a printing medium 2104 is conveyed to the fixing device and is subjected to fixing. The printing medium 2104 is sandwiched between a pressure roller 2103 and a fixing film 2102 and is subjected to heat and pressure by a heater 2101 and the pressure roller 2103, and thus a toner image 2105 is fixed to the printing medium 2104. FIG. 1B shows a situation at a point in time that is after fixing to the first printing medium 2104 has completed and that is immediately before fixing to the subsequent printing medium 2107 is started. The following examines a case where a toner image is present on the entire surface of the printing medium 2104, i.e., a case where the toner coverage ratio is high. In this case, if the temperature of the heater 2101 is at the minimum temperature required for fixing the toner image, moisture in the printing medium 2104, which has not completely evaporated, finds a way to the pressure roller 2103 side and dampens the pressure roller 2103. Consequently, slippage due to moisture occurs between the pressure roller 2103 and the fixing film 2102 before the subsequent printing medium 2107 has been conveyed. While this slippage is occurring, the same position on the fixing film 2102 is heated by the heater 2101 for a longer period of time compared to when slippage does not occur (FIG. 1C). Repetition of this situation leads to the occurrence of temperature unevenness in the fixing film 2102, and such temperature unevenness results in the occurrence of gloss unevenness after the completion of fixing to the subsequent printing medium 2107 as indicated by a reference numeral 2108 shown in FIG. 1D.

Note that the toner coverage ratio is the ratio of the number of pixels on which any of cyan, magenta, yellow, and black is present relative to the total number of pixels in one page that has been subjected to image forming. Specifically, the toner coverage ratio can be obtained by counting the number of white pixels in which no cyan, magenta, yellow, or black is present from among the total number of pixels on a single page after an image has been formed on a printing medium, and then performing the following calculation:

Toner coverage ratio=(Total number of pixels−Number of white pixels)/Total number of pixels

SUMMARY OF THE INVENTION

An aspect of the present invention is to eliminate the above-mentioned problems that occur in the conventional technology.

The present invention provides technology for preventing temperature unevenness from occurring in the fixing film, and preventing gloss unevenness from occurring when a printing medium undergoes fixing.

The present invention in one aspect provides an image forming apparatus that controls fixing of developer to a printing medium by controlling a temperature of a heater of a fixing device, comprising: a measurement unit configured to measure an actual temperature of the heater; a temperature control unit configured to control the temperature of the heater; a first obtaining unit configured to obtain, based on image data that includes a plurality of pages, an application amount of the developer on a printing medium on which a page that is to be processed has been formed; a second obtaining unit configured to obtain, based on the image data, a coverage ratio of the developer on a printing medium on which a predetermined page has been formed; a third obtaining unit configured to obtain setting temperatures of the heater that respectively correspond to the application amount and the coverage ratio; and a control unit configured to control the temperature of the heater by using the temperature control unit based on the actual temperature that has been measured by the measurement unit and the setting temperatures of the heater that have been obtained by the third obtaining unit, thereby performing control to subject the printing medium on which the page that is to be processed has been formed to fixing.

One aspect of the present invention is capable of reducing gloss unevenness that occurs due to temperature unevenness in the fixing film, while making it possible to set the temperature of the heater to be as low as possible.

Further features of the present invention will become apparent from the following description of exemplary embodiments with reference to the attached drawings.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. The same constituent elements are given the same reference numbers, and a description thereof is omitted.

The present embodiment concerns an example of obtaining a toner coverage ratio and a toner application amount from an image that has been subjected to image forming, and fixing the toner image to a printing medium while controlling the temperature of the heater of the fixing device based on the toner coverage ratio and the toner application amount.

Figure 1A:
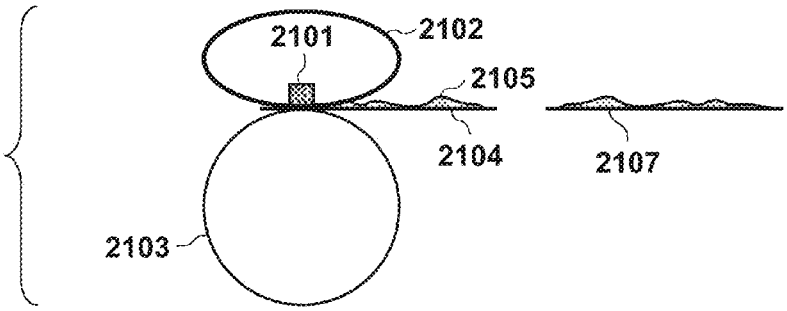
FIG. 1A to FIG. 1D are diagrams each showing a configuration of a heater, a pressure roller, and a fixing film in a fixing device.
Figure 1B:
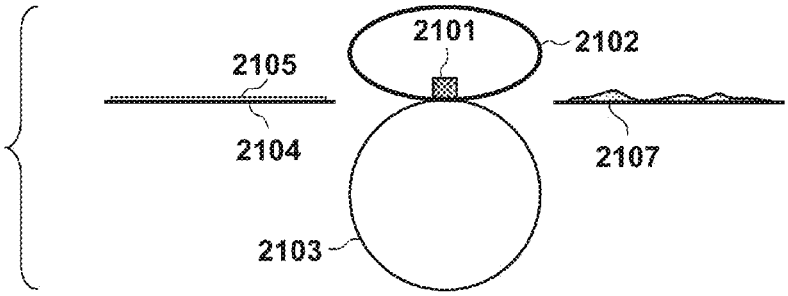
Figure 1C:
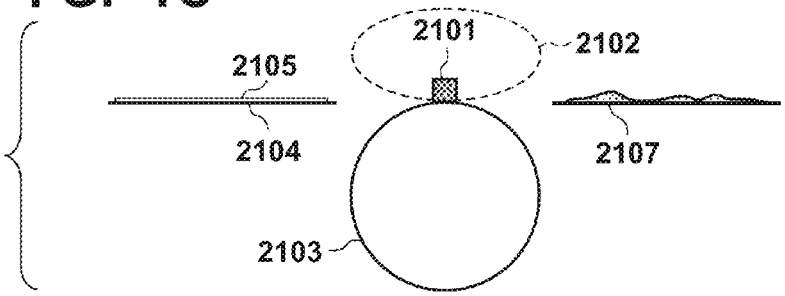
Figure 1D:
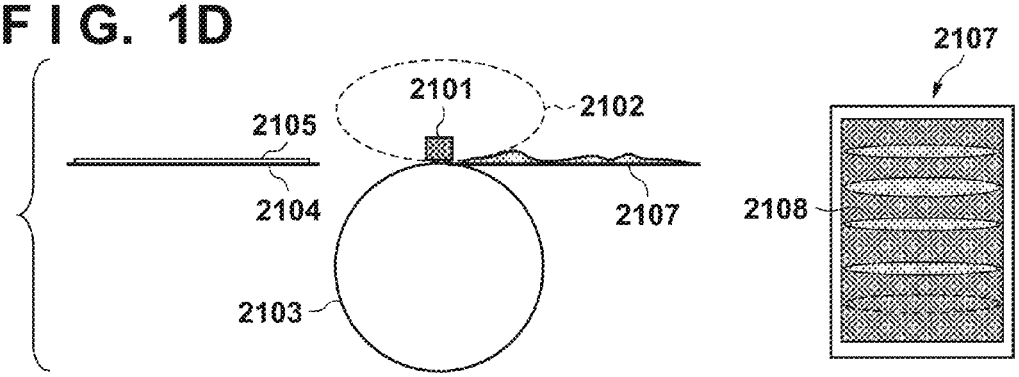
Figure 2:
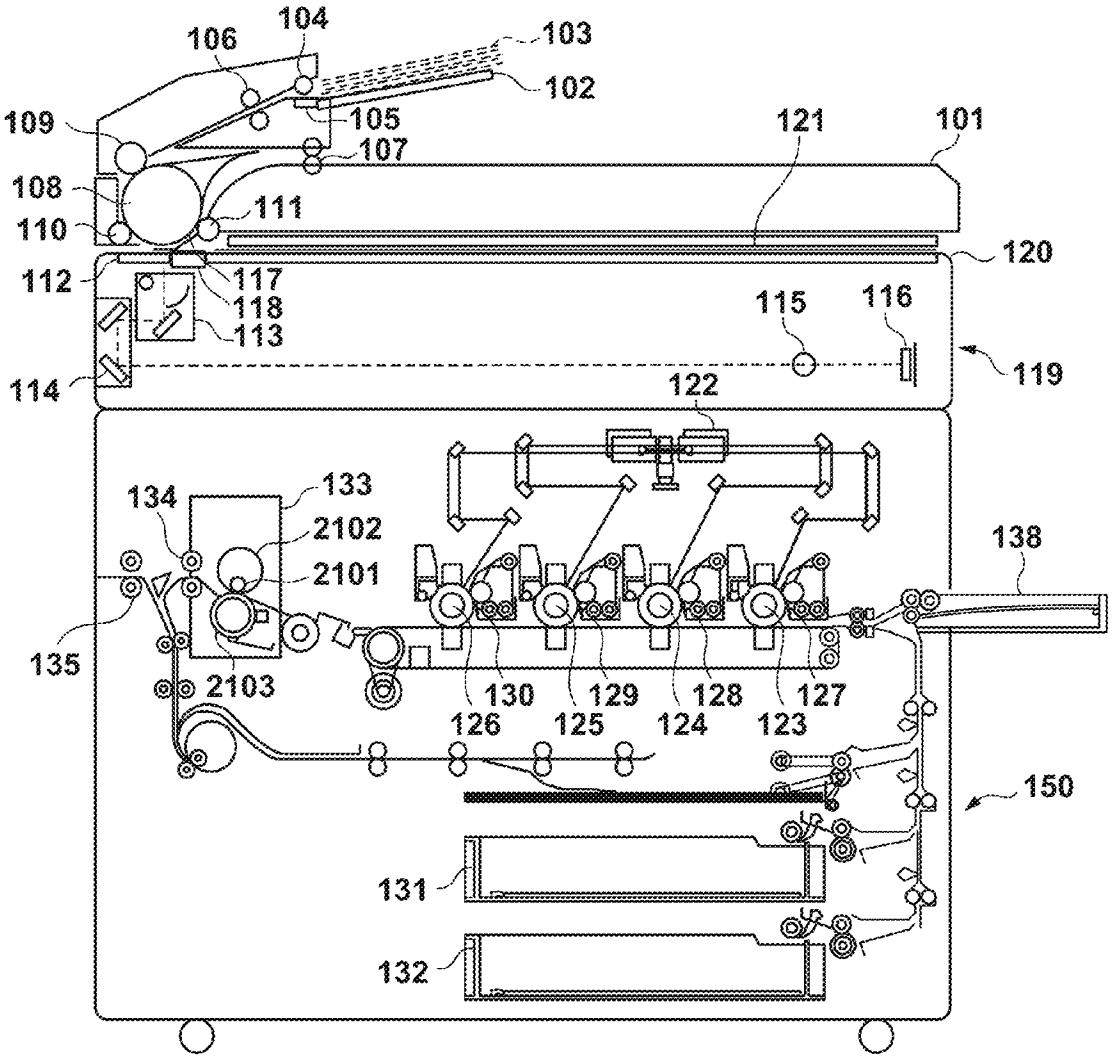
FIG. 2 is a cross-sectional diagram showing a structure of an image forming apparatus.

FIG. 2 is a cross-sectional diagram describing the structure of an image forming apparatus according to the present embodiment.

Documents 103 that are to be subjected to scanning are stacked on a tray 102 of a document feeder 101. The documents 103 are conveyed to a document scanner (a scanner) 119 one by one and are subjected to flowing document reading. More specifically, a document feed roller 104 is configured to form a pair with a separation pad 105, and feeds the documents 103 on the tray 102 one by one. A document 103 thus fed is conveyed to the inside of the document scanner 119 by an intermediate roller pair 106, is sandwiched between a major roller 108 and a first driven roller 109, and is conveyed due to the rotation of these rollers. Furthermore, the document 103 is sandwiched between the major roller 108 and a second driven roller 110, and is conveyed along the rotational direction of the major roller 108 due to the rotation of these rollers. The document 103 thus conveyed passes over a flowing document reading glass 112, a jump stage 118, and a document guide plate 117, and is conveyed by the major roller 108 and a third driven roller 111. When the documents 103 thus passes over the flowing document reading glass 112, the document surface that is in contact with the flowing document reading glass 112 is exposed to light by an exposure unit 113, and the reflected light therefrom is reflected by a mirror unit 114 and is sent to a lens 115. Light that has thus passed through the lens 115 and has been collected is converted to an electrical signal by a CCD sensor unit 116, and consequently the image signal of the image on the documents 103 is obtained. The documents 103, from which an image has thus been read, is ejected from the document scanner 119 by a document discharge roller pair 107. Note that the document 103 between the flowing document reading glass 112 and the document guide plate 117 is conveyed along the document guide plate 117 in the state of being in contact with the flowing document reading glass 112.

It is also possible to read a desired document 121 that the user wishes to copy by placing the document 121 on a platen glass 120 and pressing a start button (not shown in the drawing) of an operation unit 330 (FIG. 2) to cause the exposure unit 113 to move in the left-right direction shown in FIGS. 1A to 1D (the vertical scanning direction).

Next, a description is given of a configuration of a printer 150.

The printer 150 converts image data to a laser beam by using a laser unit 122, and forms electrostatic latent images that respectively correspond to the colors of photosensitive drums 123 to 126 by using the laser beam that is emitted from the laser unit 122. Note that the photosensitive drums 123 to 126 are each used for generating an image of the corresponding color based on a Y (yellow), M (magenta), C (cyan), or BK (black) color image signal. The electrostatic latent image thus formed on each photosensitive drum is formed as a toner image of the corresponding color by using toner (developer) of the corresponding color supplied from the corresponding developing unit among developing units 127 to 130. The toner images are sequentially transferred onto a sheet of paper that is fed from a paper feed cassette 131 or 132, or a manual feed tray 138, and ultimately a color image is formed. Note that the developing unit 127 supplies toner of the color Y (yellow), the developing unit 128 supplies toner of the color M (magenta), the developing unit 129 supplies toner of the color C (cyan), and the developing unit 130 supplies toner of the color BK (black). The sheet of paper onto which the color image has thus been transferred is conveyed to a fixing device 133 and is subjected to fixing, and is thereafter discharged to the outside of the image forming apparatus due to the rotation of conveyance roller pairs 134 and 135. Note that the heater 2101, the pressure roller 2103, and the fixing film 2102 of the fixing device 133 correspond to those shown in FIGS. 1A to 1D.

Note that the fixing film 2102 is made of a sufficiently thin material with high thermal conductivity. Consequently, it is possible to maintain the temperature of a high-temperature portion of the fixing film 2102 by sufficiently raising the temperature of the heater 2101, and to reduce the temperature difference between a high-temperature portion and a low-temperature portion of the fixing film 2102 by forcibly raising the temperature of the low-temperature portion.

Figure 3:
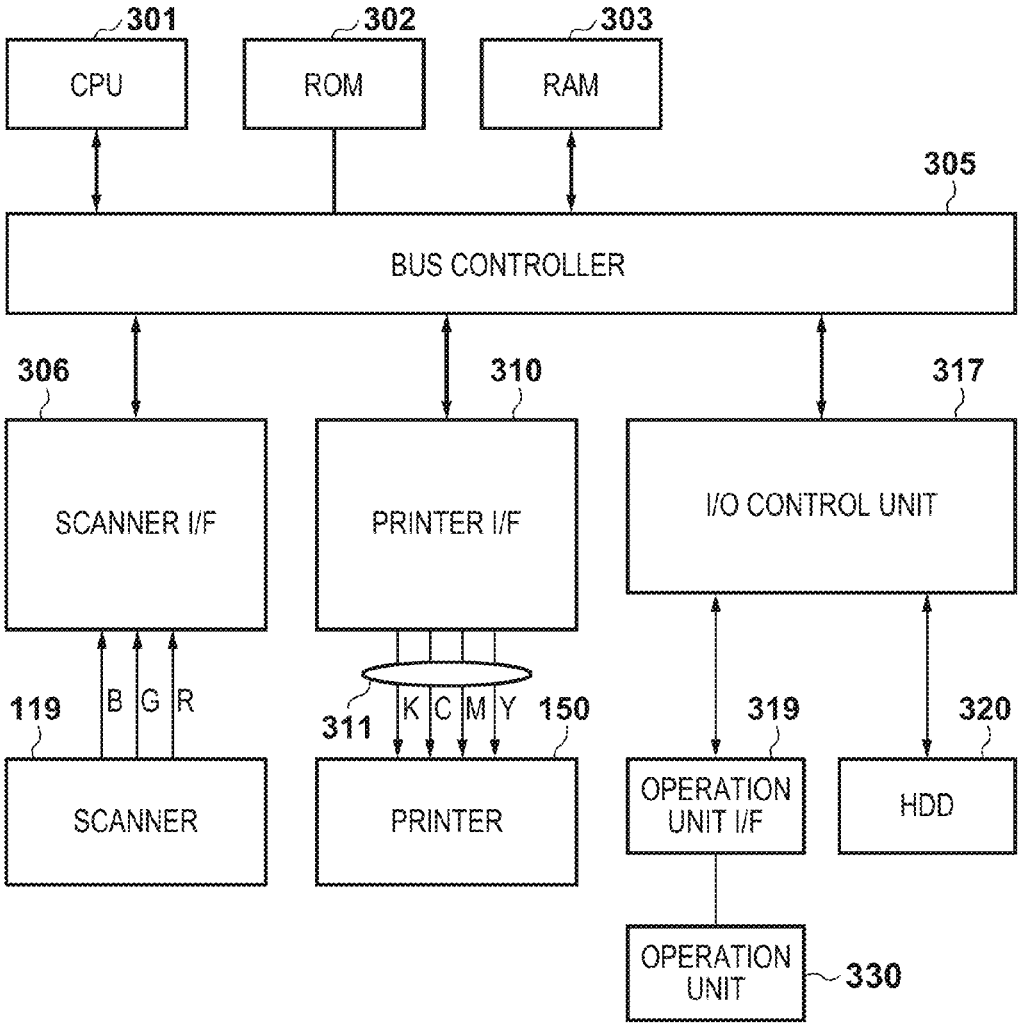
FIG. 3 is a block diagram showing a configuration of a control unit of the image forming apparatus.

FIG. 3 is a block diagram illustrating a configuration of a control unit of the image forming apparatus according to the embodiment.

A CPU 301 performs the control that is described below according to a control program that is stored in a ROM 302 or a control program that is loaded to a RAM 303 from an HDD 320 via an I/O control unit 317 by a boot program that is stored in the ROM 302.

The image data of a document that has been obtained by reading by the scanner 119 is converted to an RGB signal by the scanner 119, and is stored in the RAM 303 via a scanner I/F 306 and a bus controller 305 under the control of the CPU 301. Subsequently, the image data is stored in the HDD 320 via the I/O control unit 317. When printing the image data stored in the HDD 320, the image data is temporarily stored in the RAM 303 under the control of the CPU 301. Subsequently, the image data is subjected to a color conversion process such as conversion from RGB to CMYK, and is then sent to the printer 150 via a printer I/F 310 and is printed.

Also, the CPU 301 loads the image data stored in the HDD 320 to the RAM 303, performs a conversion from an RGB signal to a CMYK color space signal, and thereafter transfers the converted signal to the printer 150 via a video cable 311 and executes printing.

An operation unit interface 319 controls an interface with the operation unit 330, and conveys display data that is to be output to the operation unit 330, and information that has been input by the user from the operation unit 330, to the CPU 301 via the I/O control unit 317.

Figure 4:
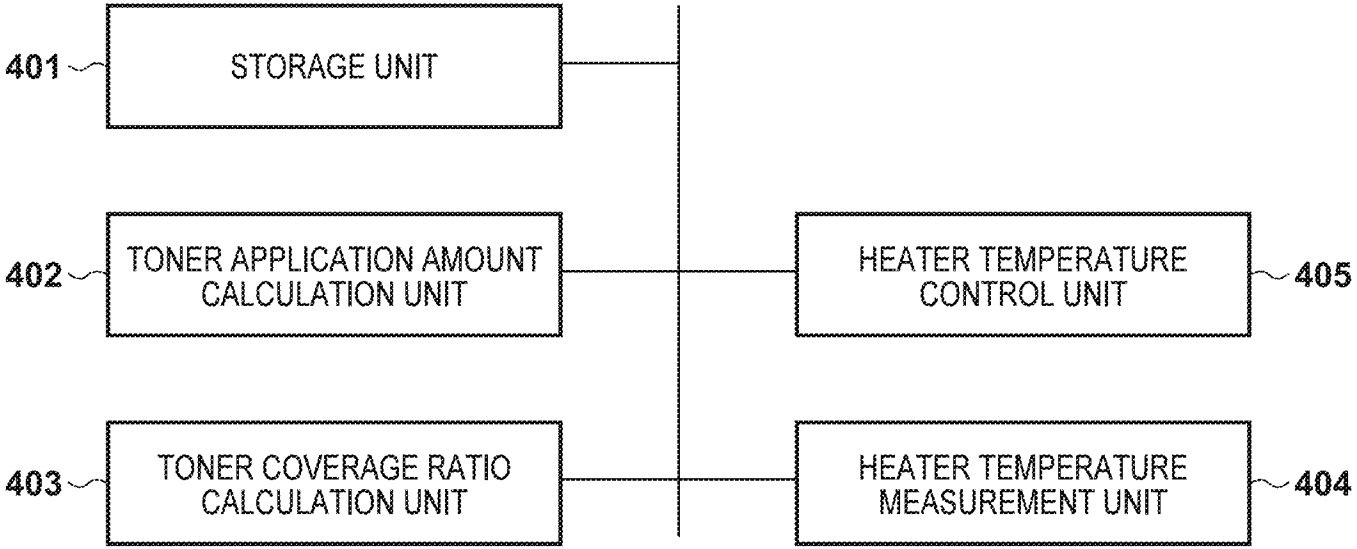
FIG. 4 is a functional block diagram of the control unit that controls the temperature of the heater of the fixing device.

FIG. 4 is a functional block diagram illustrating the functions of a control unit that controls the temperature of the heater 2101 of the fixing device 133 according to the embodiment. Note that the functions of this control unit are achieved by the CPU 301 executing a program that is stored in the ROM 302.

A storage unit 401 corresponds to the ROM 302, the RAM 303, and the HDD 320 that are shown in FIG. 3. A toner application amount calculation unit 402 calculates the toner application amount on a printing medium in a situation where a toner image has been formed on the printing medium. A toner coverage ratio calculation unit 403 calculates a toner coverage ratio on a printing medium in a situation where a toner image has been formed on the printing medium. A heater temperature measurement unit 404 measures the actual temperature of the heater 2101. A heater temperature control unit 405 obtains a heater setting temperature T1 that corresponds to the toner application amount, from the toner application amount and an application amount temperature setting table (an example of a first table) that is stored in the storage unit 401 (e.g., the ROM 302) and indicates the relationship between the toner application amount and the heater setting temperature. Furthermore, the heater temperature control unit 405 obtains a heater setting temperature T2 that corresponds to the toner coverage ratio, from the toner coverage ratio and a coverage ratio temperature setting table (an example of a second table) that is stored in the storage unit 401 (e.g., the ROM 302) and indicates the relationship between the toner coverage ratio and the setting temperature of the heater. The heater temperature control unit 405 controls the temperature of the heater 2101 based on a heater measurement temperature T3 that is obtained by the heater temperature measurement unit 404, the heater setting temperature T1 that corresponds to the toner application amount, and the heater setting temperature T2 that corresponds to the toner coverage ratio. These processes are described in detail below.

Figure 5A:
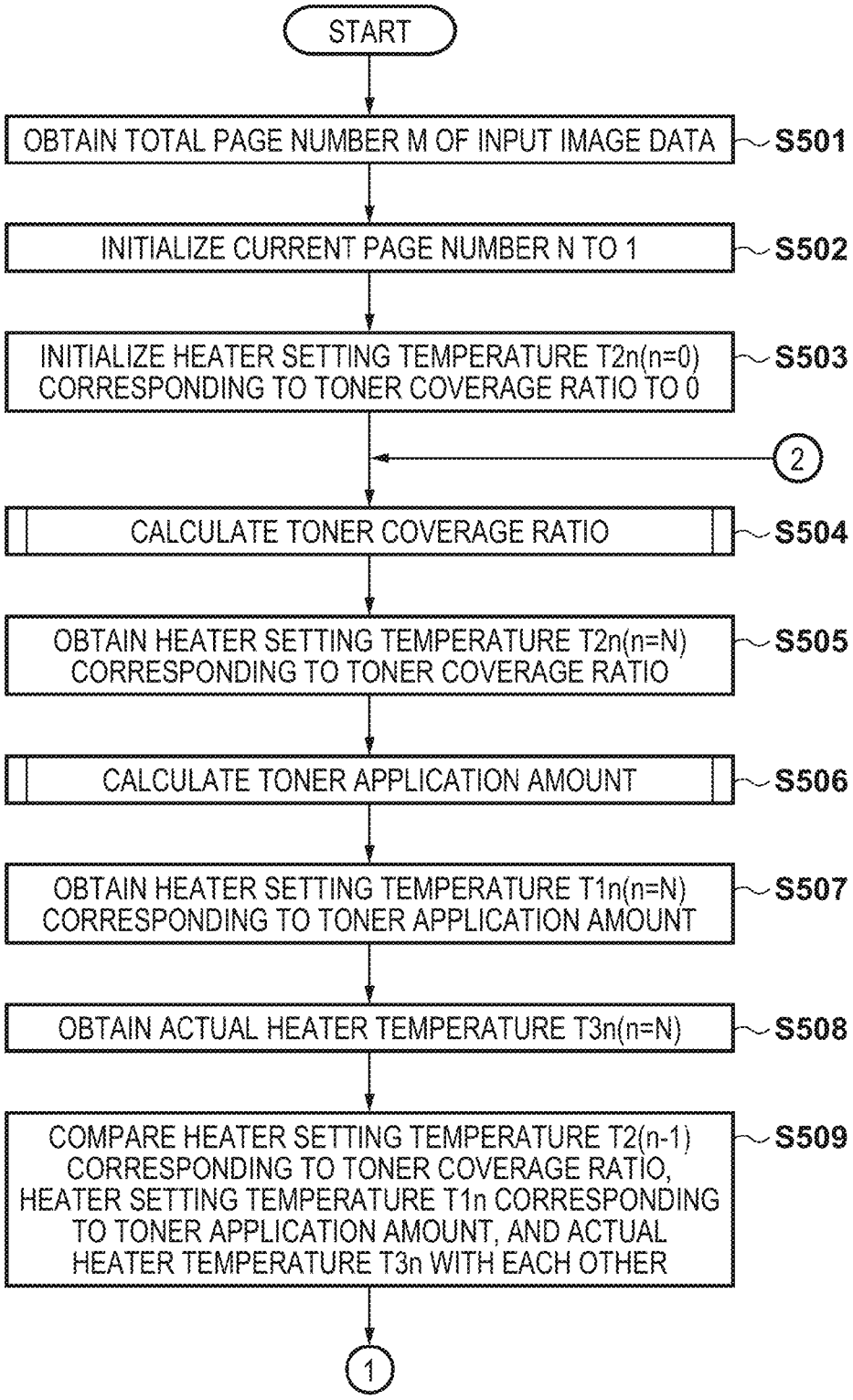
FIG. 5A and FIG. 5B are flowcharts showing processes of fixing control that are performed in the image forming apparatus.
Figure 5B:
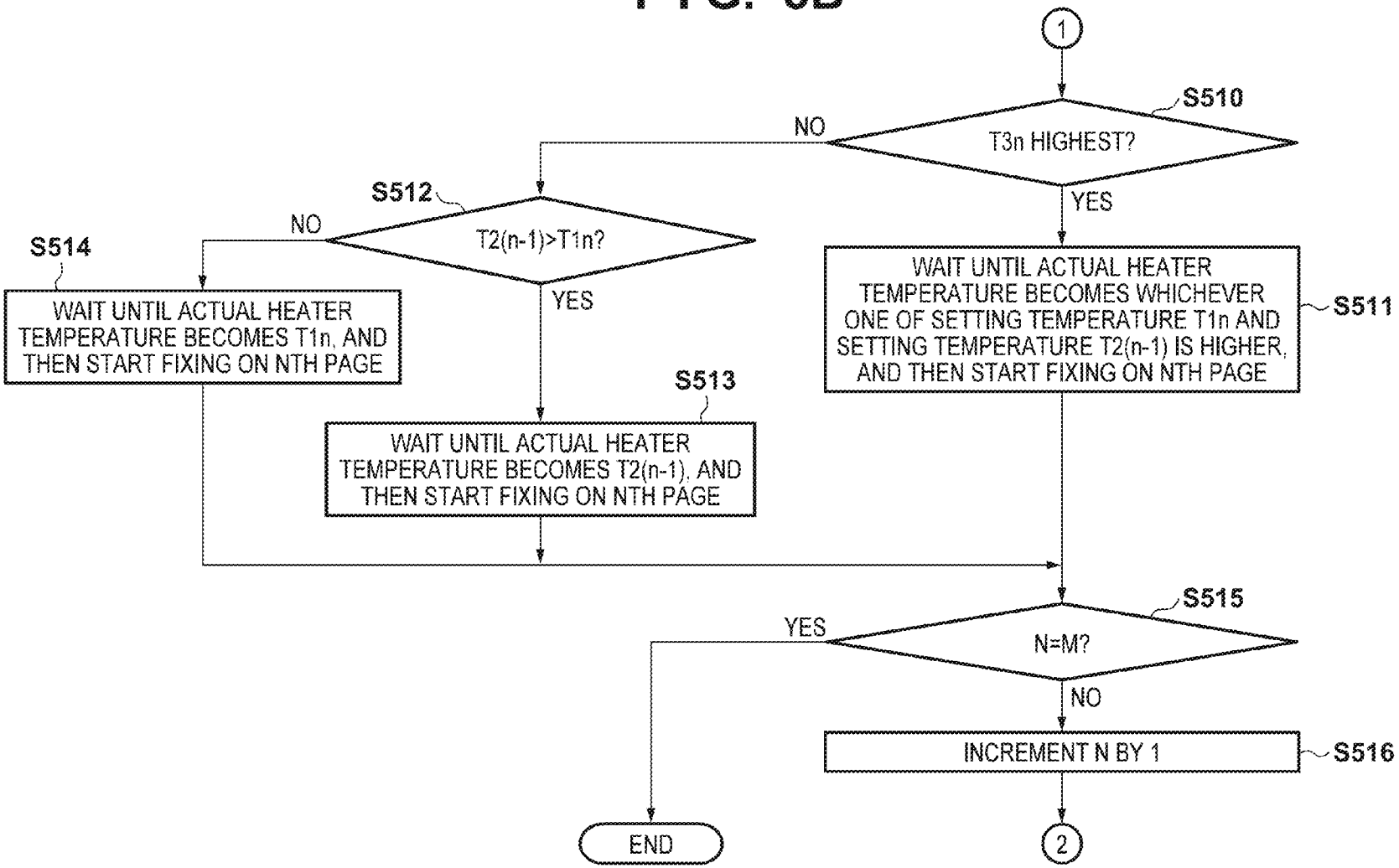

FIGS. 5A and 5B are flowcharts illustrating fixing control that is performed in the image forming apparatus according to the embodiment. Note that the program that executes the processes of fixing control is stored in the ROM 302, and the processes shown in the flowchart are realized by the CPU 301 reading out and executing the program. In the following description, the CPU 301 calculates the toner application amount and the toner coverage ratio from an image that has been subjected to image forming, and determines the corresponding heater setting temperature for each. Furthermore, the CPU 301 refers to the actual measurement temperature of the heater 2101, and controls fixing of a toner image to a printing medium by controlling the temperature of the heater 2101.

First, in step S501, upon determining that image data to be subjected to image forming has been input to the storage unit 401 (the RAM 303), the CPU 301 obtains a total number of pages M of the image data, stores the total number of pages M in the storage unit 401 (the RAM 303), and proceeds to step S502. In step S502, the CPU 301 initializes a variable N to "1", and proceeds to step S503. The variable N indicates the page number of the page that is to be processed, which has been set to the RAM 303. In step S503, the CPU 301 initializes a variable T2*n*(n=0) to "0", and proceeds to step S504. The variable T2*n* (provided in the RAM 303) indicates the temperature of the heater that corresponds to the toner coverage ratio.

In step S504, the CPU 301 functions as the toner coverage ratio calculation unit 403. The CPU 301 calculates the toner coverage ratio based on the image data that is stored in the storage unit 401, stores the toner coverage ratio thus calculated in the storage unit 401 (the RAM 303), and proceeds to step S505. The processes of calculating the toner coverage ratio in step S504 are described below with reference to the flowchart shown in FIG. 6.

Next, in step S505, the CPU 301 refers to the toner coverage ratio that is stored in the storage unit 401 and to a table (see FIG. 8) that is stored in the ROM 302 and indicates the relationship between the toner coverage ratio and the heater temperature. The CPU 301 obtains a heater setting temperature T2*n* that corresponds to the toner coverage ratio from the table, and stores the heater setting temperature T2*n* in the storage unit 401. In the example shown in FIG. 8, when the toner coverage ratio is 36%, the heater setting temperature T2*n* that corresponds to the toner coverage ratio is 200° C., for example.

Figure 8:
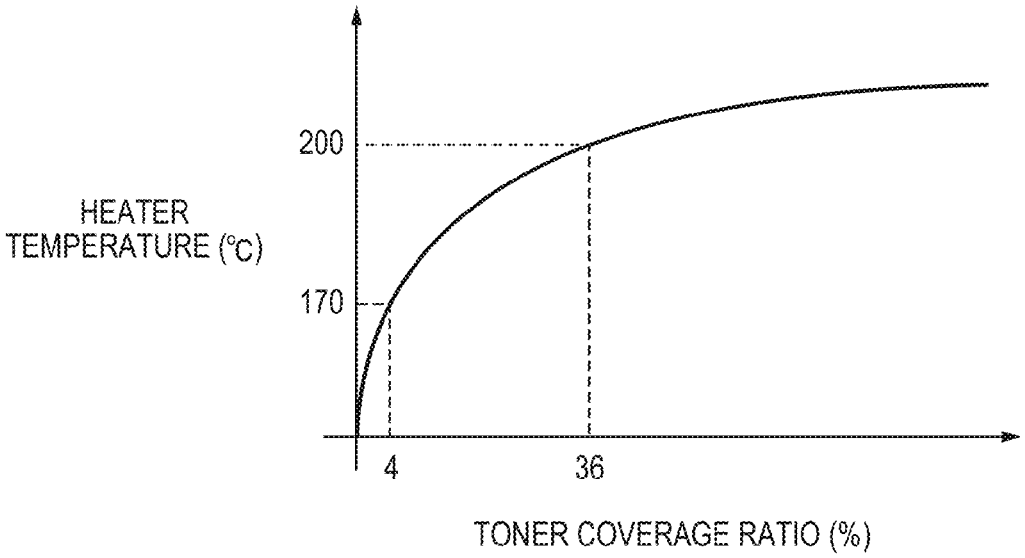
FIG. 8 is a diagram showing a table that indicates a relationship between the toner coverage ratio and a setting temperature of the heater.

FIG. 8 is a diagram showing an example of the table that indicates the relationship between the toner coverage ratio and the setting temperature of the heater.

Next, the CPU 301 proceeds to step S506 and functions as the toner application amount calculation unit 402. The CPU 301 obtains the toner application amount from the image data that is stored in the storage unit 401, stores the toner application amount thus obtained in the storage unit 401, and proceeds to step S507. The processes of calculating the toner application amount in step S506 are described below with reference to the flowchart shown in FIG. 9.

In step S507, the CPU 301 refers to the toner application amount that is stored in the storage unit 401 and to a table that is stored in the ROM 302 and that indicates the relationship between the toner application amount and the heater temperature, obtains a heater setting temperature T1*n* that corresponds to the toner application amount, and stores the heater setting temperature T1*n* in the storage unit 401.

Figure 12:
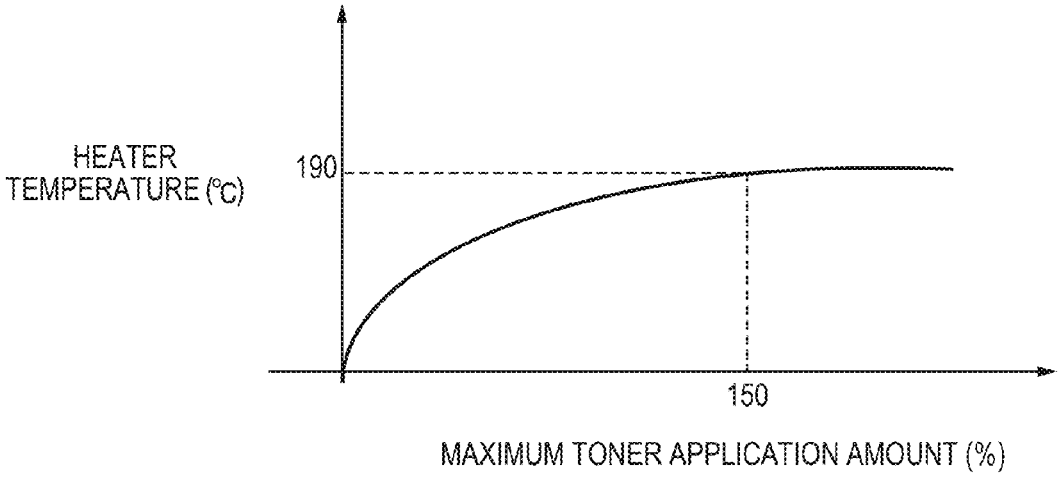
FIG. 12 is a diagram showing a table that indicates a relationship between the toner application amount and a heater temperature.

FIG. 12 is a diagram showing an example of the table that indicates the relationship between the toner application amount and the heater temperature.

In FIG. 12, the case where 100% cyan alone is applied is represented as "100%", and the case where 100% cyan and 50% magenta is applied is represented as "150%", for example. In the example shown in FIG. 12, when the maximum toner application amount is 150%, the heater setting temperature T1*n* that corresponds to the toner application amount is 190° C.

Next, the CPU 301 proceeds to step S508, and measures an actual temperature T3*n* of the heater 2101 by using the heater temperature measurement unit 404 and stores the actual temperature T3*n* in the storage unit 401. Next, the CPU 301 proceeds to step S509, and compares a heater setting temperature T2(*n*−1) that is stored in the storage unit 401 and that corresponds to the toner coverage ratio of the previous page, the heater setting temperature T1*n* that corresponds to the toner application amount on the page that is to be processed, and the actual temperature T3*n* of the heater 2101, with each other. Then, the CPU 301 proceeds to step S510 and determines whether or not the actual temperature T3*n* of the heater 2101 is the highest, based on the result of the determination performed in step S509. Upon determining that the actual temperature T3*n* of the heater 2101 is the highest, the CPU 301 proceeds to step S511 and sets the temperature of the heater 2101 at the time of fixing on the current page to be whichever one of the heater setting temperature T1*n* that corresponds to the toner application amount and the heater setting temperature T2(*n*−1) that corresponds to the toner coverage ratio of the previous page is higher. Then, the CPU 301 lowers the temperature of the heater 2101 to the temperature thus set, performs control to start fixing on a page N that is to be processed, and proceeds to step S515.

On the other hand, upon determining in step S510 that the actual temperature T3*n* of the heater 2101 is not the highest, the CPU 301 proceeds to step S512. This applies to the case where: the heater setting temperature T2(*n*−1) that corresponds to the toner coverage ratio is 200° C.; the heater setting temperature T1*n* that corresponds to the toner application amount is 190° C.; and the actual temperature T3*n* of the heater 2101 is 185° C., for example. In step S512, the CPU 301 determines whether or not the heater setting temperature T2(*n*−1) that corresponds to the toner coverage ratio of the previous page is higher than the heater setting temperature T1*n* that corresponds to the toner application amount, and proceeds to step S513 upon determining affirmatively. This applies to the case where: the heater setting temperature T2(*n*−1) that corresponds to the toner coverage ratio of the previous page is 200° C.; and the heater setting temperature T1*n* that corresponds to the toner application amount on the current page is 190° C., for example. In step S513, the CPU 301 raises the temperature of the heater 2101 by controlling the temperature of the heater 2101 so that the temperature of the heater 2101 reaches T2(*n*−1). Upon determining that the temperature of the heater 2101 has reached T2(*n*−1) by using the heater temperature measurement unit 404, the CPU 301 performs control to start fixing on the page N that is to be processed, and proceeds to step S515. Specifically, the CPU 301 waits until the temperature of the heater 2101 reaches T2(*n*−1), e.g., 200° C., before starting fixing on the page N.

On the other hand, upon determining in step S512 that the heater setting temperature T1*n* that corresponds to the toner application amount on the current page is higher than or equal to the heater setting temperature T2(*n*−1) that corresponds to the toner coverage ratio of the previous page, the CPU 301 proceeds to step S514. In step S514, the CPU 301 raises the temperature of the heater 2101 by controlling the temperature of the heater 2101 so that the actual temperature of the heater 2101 reaches T1*n*. The CPU 301 waits until the temperature of the heater 2101 measured by the heater temperature measurement unit 404 reaches T1*n*, and then starts fixing on the page N that is to be processed, and proceeds to step S515.

In step S515, the CPU 301 determines whether or not the current page number N is equal to the total number of pages M. If N is not M, the CPU 301 proceeds to step S516, increments the variable N by one, and proceeds to step S504. The CPU 301 repeats these processes. On the other hand, if the variable N is equal to the total number of pages M in step S515, the CPU 301 ends the processes because fixing on all of the M pages has completed.

Note that in the case of the first page, the setting temperature T2(*n*−1) of the heater 2101 for the previous page does not exist. Therefore, if this is the case, in step S511, the CPU 301 sets the temperature of the heater 2101 at the time of fixing on the current page to be the heater setting temperature T1*n* that corresponds to the toner application amount, and then performs fixing on the first page. Also, in step S514, the CPU 301 waits until the actual temperature T3*n* of the heater 2101 reaches the heater setting temperature T1*n* that corresponds to the toner application amount, and then starts fixing on the first page. Note that step S513 is not performed for the first page.

According to the above-described processes, if the actual temperature T3*n* of the heater 2101 is higher than the heater setting temperature T2(*n*−1) that corresponds to the toner coverage ratio and the heater setting temperature T1*n* that corresponds to the toner application amount, the CPU 301 starts fixing when the actual temperature T3*n* reaches whichever one of the heater setting temperature T2(*n*−1) and the heater setting temperature T1*n* is higher. If the actual temperature T3*n* of the heater 2101 is lower than the heater setting temperatures T2(*n*−1) and T1*n*, the CPU 301 changes the actual temperature T3*n* of the heater 2101 to be whichever one of the heater setting temperature T(2*n*-1) that corresponds to the toner coverage ratio and the heater setting temperature T1*n* that corresponds to the toner application amount is higher, and then starts fixing.

Consequently, it is possible to perform fixing while maintaining the temperature of the heater 2101 at an appropriate temperature, and it is therefore possible to prevent slippage from occurring between the fixing film 2102 and the pressure roller 2103.

Next, a description is given of the procedures according to the embodiment by which the toner coverage ratio calculation unit 403 calculates the toner coverage ratio from image data.

Figure 6:
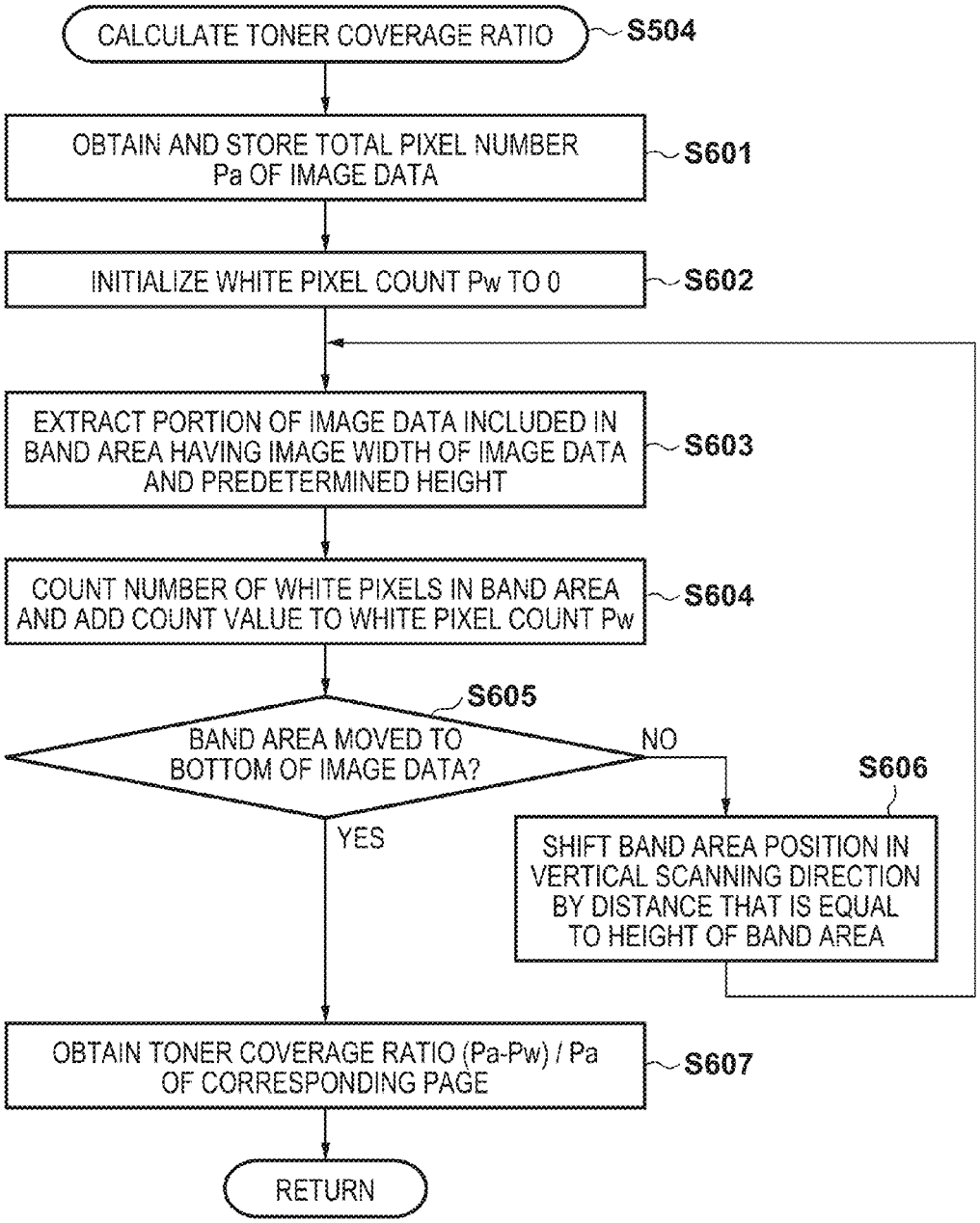
FIG. 6 is a flowchart showing procedures for calculation of a toner coverage ratio that is performed in step S504 shown in FIG. 5A.

FIG. 6 is a flowchart showing the procedures for calculation of the toner coverage ratio performed in step S504 of FIG. 5A. Note that the program that executes the processes is stored in the ROM 302, and the processes shown in the flowchart are realized by the CPU 301 reading out and executing the program.

First, in step S601, the CPU 301 obtains a total number of pixels Pa from the image data, stores the total number of pixels Pa in the storage unit 401 (RAM 303), and proceeds to step S602. In step S602, the CPU 301 initializes a white pixel count Pw to "0". The white pixel count Pw is provided in the RAM 303 and stores therein the count value of white pixels. Next, the CPU 301 proceeds to step S603, and extracts a portion of the image data that is included in a band area having an image width of the image data and a predetermined height.

Figure 7A:
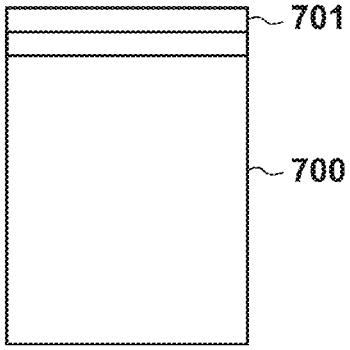
FIG. 7A and FIG. 7B are diagrams illustrating a band area that is set on image data.

FIG. 7A is a diagram illustrating a band area that is set on image data 700.

Here, a band area 701 having the same width as the image width of the image data 700 and a predetermined height is set.

Next, the CPU 301 proceeds to step S604, counts the number of white pixels in the band area 701, and adds the count value thus obtained to the white pixel count Pw in the RAM 303.

Figure 7B:
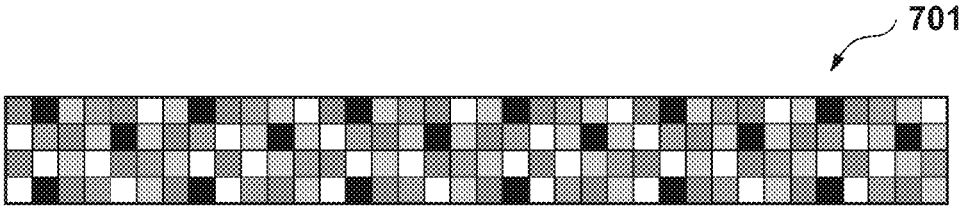

FIG. 7B is an enlargement of the band area 701 shown in FIG. 7A. The band area 701 is image data that is composed of pixels of four colors, namely cyan, magenta, yellow, and black. Here, it is assumed that pixels on which none of the colors cyan, magenta, yellow, and black are present are regarded as white pixels.

Next, the CPU 301 proceeds to step S605, and determines whether or not the band area 701 has moved to the bottom of the image data 700. The CPU 301 proceeds to step S607 upon determining affirmatively, and otherwise proceeds to step S606. In step S606, the CPU 301 moves the band area 701 in the vertical scanning direction of the image data 700 by a distance that is equal to the height of the band area 701, and proceeds to step S603. The CPU 301 then repeats the above-described processes.

In step S607, the CPU 301 obtains the toner coverage ratio of the corresponding page by subtracting the white pixel count Pw from the total number of pixels Pa and dividing the result by the total number of pixels Pa, and stores the toner coverage ratio thus obtained in the RAM 303 (the storage unit 401). In the present embodiment, a description is given of an example in which the number of pixels in image data is obtained in units of bands. However, the processes of obtaining the number of pixels are not necessarily performed in units of bands.

Through these processes, it is possible to obtain the toner coverage ratio of one page, which is the ratio of the value obtained by subtracting the number of white pixels from the total number of pixels in the image data of one page, relative to the total number of pixels.

Next, a description is given of the procedures according to the embodiment until the completion of calculation of the maximum toner application amount from an area of input image data 900 that has been subjected to image forming. The area has a size that is greater than or equal to a predetermined size.

According to these procedures, first the toner coverage ratio is obtained by the toner coverage ratio calculation unit 403, and then the process by which the toner application amount calculation unit 402 obtains the toner application amount is activated.

Figure 9:
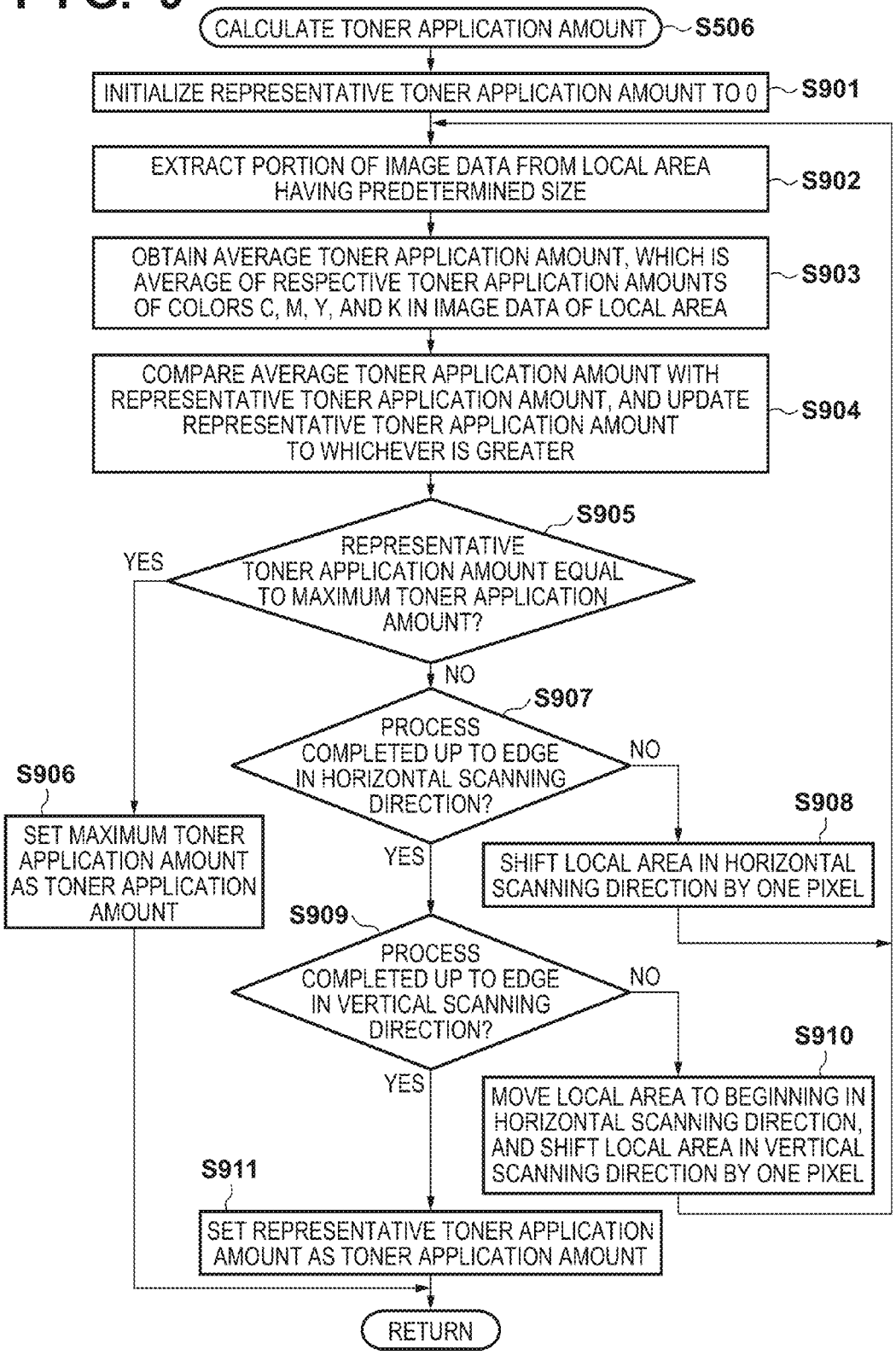
FIG. 9 is a flowchart showing processes of calculation of a toner application amount that is performed in step S506 shown in FIG. 5A.

FIG. 9 is a flowchart showing the processes of calculation of the toner application amount that is performed in step S506 of FIG. 5A. Note that the program that executes the processes is stored in the ROM 302, and the processes shown in the flowchart are realized by the CPU 301 reading out and executing the program.

First, in step S901, the CPU 301 initializes a representative toner application amount to "0", and stores the amount in the storage unit 401 (RAM 303). Next, the CPU 301 proceeds to step S902, and extracts a portion of image data 1000 stored in the storage unit 401 (FIG. 10), from an area 1001 that has a predetermined size (FIG. 10).

Figure 10:
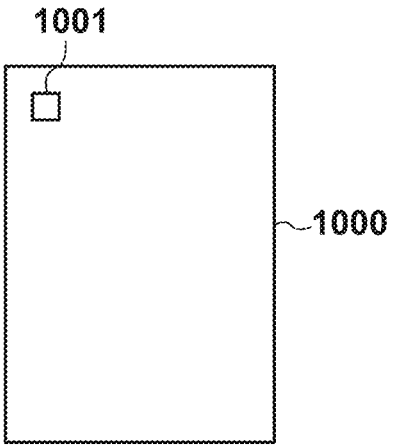
FIG. 10 is a diagram showing a relationship between image data and a predetermined area.

FIG. 10 is a diagram showing the relationship between the image data 1000 and the predetermined area 1001.

Next, the CPU 301 proceeds to step S903, obtains the average of the respective amounts of the plurality of colors, namely cyan, magenta, yellow, and black, in the image data of the local area 1001 from the total amount of these colors, and stores the average in the RAM 303 as the average toner application amount in the local area 1001.

Figure 11:
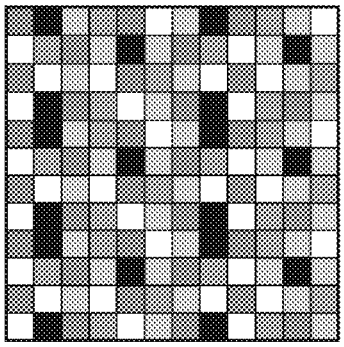
FIG. 11 is an enlargement of a local area of the image data shown in FIG. 10.

FIG. 11 is an enlargement of the local area 1001 of the image data 1000 shown in FIG. 10, and shows an image that has been subjected to image forming and is composed of four colors, namely cyan, magenta, yellow, and black.

Next, the CPU 301 proceeds to step S904, compares the average toner application amount on the local area 1001, which is stored in the storage unit 401 (RAM 303), with the representative toner application amount, and updates the representative toner application amount to be whichever one of these amounts is greater. Initially, the representative toner application amount is "0", and therefore the average toner amount on the local area 1001 is stored in the RAM 303 as the representative toner application amount. Next, the CPU 301 proceeds to step S905, and determines whether or not the representative toner application amount that has been updated in step S904 is equal to the maximum toner application amount. If the representative toner application amount is equal to the maximum toner application amount, the CPU 301 proceeds to step S906. The maximum toner application amount indicates the maximum amount of toner that can be applied on a printing medium. It is assumed that the maximum toner application amount has been determined and stored in the ROM 302 in advance. In step S906, the toner application amount calculation unit 402 sets the maximum toner application amount as the toner application amount, and ends the processes.

On the other hand, if the CPU 301 determines in step S905 that the representative toner application amount is not equal to the maximum toner application amount, the CPU 301 proceeds to step S907. In step S907, the CPU 301 determines whether or not the local area 1001 has moved to the edge of the image data 1000 in the horizontal scanning direction, and upon determining negatively, proceeds to step S908. The CPU 301 then moves the local area 1001 by one pixel in the horizontal scanning direction, and proceeds to step S902. The CPU 301 repeats these processes.

On the other hand, upon determining in step S907 that the local area 1001 has moved to the edge of the image data 1000 in the horizontal scanning direction, the CPU 301 proceeds to step S909. In step S909, the CPU 301 determines whether or not the local area 1001 has moved to the edge of the image data 1000 in the vertical scanning direction. If the local area 1001 has not moved to the edge, the CPU 301 proceeds to step S910. In step S910, the CPU 301 moves the local area 1001 to the beginning in the horizontal scanning direction, and moves the local area 1001 by one pixel in the vertical scanning direction, and proceeds to step S902. The CPU 301 repeats these processes.

Thus, upon determining in step S909 that the local area 1001 has moved to the edge of the image data 1000 in the horizontal scanning direction, i.e., when the maximum average toner application amount on the local area 1001 throughout the entire image data 1000 has been obtained, the CPU 301 proceeds to step S911. In step S911, the CPU 301 sets the representative toner application amount, i.e., the maximum average toner application amount on the local area 1001, as the toner application amount on the corresponding page, and ends the processes.

Although the description above has been given of processes that are performed on a local area, processes are not necessarily performed on a local area. Also, although the above-described local area has the shape of a band or a rectangle, this is not essential. It is acceptable to set the local area to have the shape of a rectangle when calculating the toner coverage ratio, and set the local area to have the shape of a band when calculating the toner application amount.

Also, in the embodiment above, the predetermined area is set to have the shape of a band or a rectangle, and the number of white pixels and the toner application amount are calculated while moving (applying) the predetermined area throughout the entire image data. However, the method for moving the predetermined area is not limited to the embodiment. The number of white pixels and the toner application amount may be calculated from all of the image data.

The present invention is not limited to the above-described embodiment, and various changes and modifications can be made without departing from the spirit or scope of the present invention.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-031929, filed Feb. 20, 2015, which is hereby incorporated by reference herein in its entirety.

What is claimed is:

1. An image forming apparatus that controls fixing of developer to a printing medium by controlling a temperature of a heating member of a fixing device, comprising:

a measurement unit configured to measure an actual temperature of the heating member;

a temperature control unit configured to control the temperature of the heating member;

a first obtaining unit configured to obtain, based on image data that includes a plurality of pages, an application amount of the developer on a printing medium on which a page that is to be processed has been formed;

a second obtaining unit configured to obtain, based on the image data, a coverage ratio of the developer on a printing medium on which a predetermined page has been formed;

a third obtaining unit configured to obtain setting temperatures of the heating member that respectively correspond to the application amount and the coverage ratio; and a control unit configured to control the temperature of the heating member by using the temperature control unit based on the actual temperature that has been measured by the measurement unit and the setting temperatures of the heating member that have been obtained by the third obtaining unit, thereby performing control to subject the printing medium on which the page that is to be processed has been formed to fixing.

2. The image forming apparatus according to claim 1, wherein the third obtaining unit has a first table that indicates a heating member temperature that corresponds to the application amount, and a second table that indicates a heating member temperature that corresponds to the coverage ratio, and obtains the setting temperatures of the heating member that respectively correspond to the application amount and the coverage ratio by referring to the first table and the second table.

3. The image forming apparatus according to claim 1, wherein the predetermined page is a previous page to the page that is to be processed.

4. The image forming apparatus according to claim 1, wherein, when the actual temperature that has been measured by the measurement unit is higher than the setting temperatures of the heating member that have been obtained by the third obtaining unit, the control unit lowers the temperature of the heating member using the temperature control unit to the higher one of the setting temperature of the heating member corresponding to the application amount and the setting temperature corresponding to the coverage ratio, and thereafter performs control to subject the printing medium on which the page that is to be processed has been formed to fixing.

5. The image forming apparatus according to claim 1, wherein, when the actual temperature that has been measured by the measurement unit is lower than the setting temperatures of the heating member that have been obtained by the third obtaining unit, the control unit raises the temperature of the heating member using the temperature control unit to the higher one of the setting temperature of the heating member corresponding to the application amount and the setting temperature corresponding to the coverage ratio, and thereafter performs control to subject the printing medium on which the page that is to be processed has been formed to fixing.

6. The image forming apparatus according to claim 1, wherein, when the page to be processed is a first page, the control unit controls the temperature of the heating member by using the temperature control unit based on the actual temperature that has been measured by the measurement unit and the setting temperature of the heating member that corresponds to the application amount that has been obtained by the third obtaining unit, and performs control to subject a printing medium on which the first page has been formed to fixing.

7. The image forming apparatus according to claim 1, wherein the first obtaining unit:

includes an extraction unit configured to extract a portion of the image data from a predetermined area of the image data; and obtains an average of respective application amounts of a plurality of colors of the developer from a total of the application amounts of the plurality of colors that correspond to the portion of the image data in the predetermined area that has been extracted by the extraction unit, and obtains, as the application amount of the developer on the printing medium on which the page to be processed has been formed, a maximum amount that has been obtained by applying the predetermined area throughout the entire image data.

8. The image forming apparatus according to claim 1, wherein the second obtaining unit:

includes an extraction unit configured to extract a portion of the image data from a predetermined area of the image data; and obtains a number of white pixels in the portion of the image data in the predetermined area that has been extracted by the extraction unit, and obtains the coverage ratio of the developer from a ratio of a total number of white pixels that has been obtained by applying the predetermined area throughout the entire image data relative to a total number of pixels in the page to be processed.

9. The image forming apparatus according to claim 1, wherein the fixing device includes a fixing film to which heat generated by the heating member is applied, and a pressure roller, and the fixing film and the pressure roller apply heat and pressure to the printing medium, respectively.

10. A control method for controlling an image forming apparatus that controls fixing of developer to a printing medium by controlling a temperature of a heating member of a fixing device, comprising:

measuring an actual temperature of the heating member;

controlling the temperature of the heating member;

obtaining, based on image data that includes a plurality of pages, an application amount of the developer on a printing medium on which a page that is to be processed has been formed;

obtaining, based on the image data, a coverage ratio of the developer on a printing medium on which a predetermined page has been formed;

obtaining setting temperatures of the heating member that respectively correspond to the application amount and the coverage ratio; and controlling the temperature of the heating member based on the actual temperature that has been measured and the setting temperatures of the heating member that have been obtained, thereby performing control to subject the printing medium on which the page that is to be processed has been formed to fixing.

11. A non-transitory computer-readable storage medium that stores therein a program that causes a computer to:

measure an actual temperature of a heating member of a fixing device;

control a temperature of the heating member;

obtain, based on image data that includes a plurality of pages, an application amount of a developer on a printing medium on which a page that is to be processed has been formed;

obtain, based on the image data that includes the plurality of pages, a coverage ratio of the developer on a printing medium on which a predetermined page has been formed;

obtain setting temperatures of the heating member that respectively correspond to the application amount and the coverage ratio; and control the temperature of the heating member based on the actual temperature that has been measured and the setting temperatures of the heating member that have been obtained, thereby performing control to subject the printing medium on which the page that is to be processed has been formed to fixing.

* * * * *